US006070738A

United States Patent [19]

Lyman et al.

[11] Patent Number: 6,070,738

[45] Date of Patent: Jun. 6, 2000

[54] DYNAMIC MONITORING AND CONTROL OF JIGS

[75] Inventors: Geoffrey John Lyman; Andrew Jonkers, both of Bellbowrie, Australia

[73] Assignee: The University of Queensland, Queensland, Australia

[21] Appl. No.: 09/029,582

[22] PCT Filed: Sep. 9, 1996

[86] PCT No.: PCT/AU96/00556

§ 371 Date: Mar. 6, 1998

§ 102(e) Date: Mar. 6, 1998

[87] PCT Pub. No.: WO97/09116

PCT Pub. Date: Mar. 13, 1997

[30] Foreign Application Priority Data

Sep. 8, 1995 [AU] Australia ..... PN 5319

[51] Int. Cl.[7] ..... B03B 5/52; B03B 11/04; B03B 11/00

[52] U.S. Cl. ..... 209/457; 209/489; 209/491; 209/496

[58] Field of Search ..... 209/457, 489, 209/454, 455, 456, 488, 490, 491, 496

[56] References Cited

U.S. PATENT DOCUMENTS

| | | | |
|---|---|---|---|
| 4,265,744 | 5/1981 | Weiffen . | |
| 4,358,827 | 11/1982 | Abbott . | |
| 5,028,317 | 7/1991 | Lyman | 209/457 |
| 5,541,831 | 7/1996 | Thomas | 209/489 |

FOREIGN PATENT DOCUMENTS

| | | |
|---|---|---|
| 48303/85 | 4/1986 | Australia . |
| 40362/95 | 6/1996 | Australia . |
| 40363/95 | 6/1996 | Australia . |
| 0 042 771 | 12/1981 | European Pat. Off. . |
| 31 06 114 | 9/1982 | Germany . |
| 34 45 937 | 6/1986 | Germany . |
| 35 06 485 | 8/1986 | Germany . |
| 2 085 322 | 4/1982 | United Kingdom . |
| 2 090 019 | 6/1982 | United Kingdom . |
| 2 131 182 | 6/1984 | United Kingdom . |
| 2 189 717 | 11/1987 | United Kingdom . |
| 88/00095 | 1/1988 | WIPO . |

*Primary Examiner*—Donald P. Walsh
*Assistant Examiner*—Brett C. Martin
*Attorney, Agent, or Firm*—Griffin, Butler, Whisenhunt & Szipl, LLP

[57] ABSTRACT

The monitoring and control of jig separators is effected by monitoring the time variation within a jig cycle of at least one operating parameter of the jig, and manipulating the operating parameter(s) to produce the sought after form of the time variation within the jig cycle. Operating parameters include bed voidage, water level, particle velocity in the bed and water or air pressure.

7 Claims, 3 Drawing Sheets

DYNAMIC MONITORING AND CONTROL OF JIGS

BACKGROUND OF THE INVENTION (1) Field of Invention

THIS INVENTION relates to the dynamic monitoring and control of jigs.

(2) Prior Art

The University of Queensland has patented and developed a control system for jigs that is centred on the concept that the jig can be controlled in response to measurement of the time variation of a signal during a cycle for the jig pulsation. The idea of signal averaging over a number of jig cycles is also invoked to provide more accurate signals and the Patent refers particularly to the measurement of density in the jig bed as a function of time. The Abstract of Australian Patent No. 596858 (AU-B-76489187) states:

"The density of the material in the jig bed is measured in consecutive short segments over the jig cycle, the time period of each segment not being greater than one-tenth the cycle time of the jig, to determine the density signature or profile of the jig. By controlling the operating parameters (e.g. inlet and outlet valve opening and closing, underbed water flow rate, discharge gate position and jig working air (pressure) of the jig, the density signature or profile is maintained within a control envelope for efficient stratification of the mineral."

It is relevant to outline some basic aspects of the physics of operation of jigs, including centrifugally-aided jigs also known as Kelsey jigs. These concepts are also applicable within minor modification to moving screen jigs.

The separation in a jig occurs as a result of the passage of a pulsating flow of water through a bed of particles that are supported on a screen or punched plate. As the water flows through the screen and into the bed of particles (pulsion phase of flow—consider such a flow direction to be positive or 'upward'), the fluid drag on the particles supports more and more of the weight of the bed of particles until at some critical velocity, the bed of particles lifts. Further increase in fluid velocity causes fluidisation and dilation (decrease in the volume fraction of solids) of the bed. As the pulsion phase of the flow finishes and the fluid velocity reverses and increases in velocity downwards, the dilation of the bed rapidly decreases and the bed is forced back against the bed plate. Further increase in the downward velocity causes a significant pressure drop to develop across the bed.

Superimposed on this pulsating flow is a relatively small constant upflow of water through the bed. The purpose of this flow is to supply a current of water above the bed plate that will assist in the transport of the particles in a direction perpendicular to the pulsing flow. In a continuous jig, the particles of coal or mineral are transported from the feed end of the jig to the discharge end and the bed becomes progressively more stratified or better separated or better sorted as the material moves from the feed end to the discharge end.

The extent of separation is gauged by the extent to which particles of different size and true particle density become sorted in the bed. For example, for a particle bed composed of only one size of particle, but having a range of particle densities, an arrangement of particles in the bed such that particle density decreases monotonically from the bed plate towards the top of the bed would be considered to be perfectly sorted or separated.

The manner in which particles of differing density move from one layer to another in the bed as separation progresses depends on the extent to which the particle bed dilates and the relative vertical motion of the particles in response to the fluid flow through the particle bed. When a broad distribution of particle sizes exists in the bed, particle motion can also occur in the bed by a trickling mechanism wherein small particles move through the interstices of the packed bed.

One must also distinguish between two general methods of jigging separation, namely 'through the screen' separation or 'over the screen separation'. In the first case, the bed becomes stratified or sorted with high density particles moving towards the bed plate and low density particles moving towards the top of the bed. If the apertures in the bed plate are sufficiently large, particles of high density material may pass through the plate into the space (known generally as the hutch) on the other side of the bed plate for collection. Generally, when high density particles are concentrated in this way, a quantity of relatively large relatively high density particles are added to the bed with the intention that these particles shall remain in the bed next to the bed plate and form a 'ragging' bed through the interstices of which the smaller particles to be concentrated may move. In the second case of over the screen separation, no ragging is added and the entire mass of feed material is allowed to stratify under the influence of the pulsations. A means of splitting the bottom layers of the bed from the upper layers of the bed is provided at the discharge end of the jig so that high density and low density products are recovered from the separator.

Finally, one must note that through the screen and over the screen jigging mechanisms of separation can function simultaneously in a jig.

SUMMARY OF THE INVENTION

Since application for Australian Patent No. 596858, the concepts of control for jigs have developed in accordance with the invention to include control of the water motion of the jig in response to measurements of the dynamic water level and other signals in the jig, amongst other concepts. More generally, control of jigs so as to maintain constant in form the time variation of measured signals, other than bed density, that can be considered to be linked to the performance of the jig has been developed.

Not only can the form of the time variation of a signal from the jig provide a source signal for automatic control actions, but also the signal itself can be considered as a 'signature' whose particular form indicates correct operation of the jig and departure from that form indicates abnormal operation or indicates a change in the nature of the material or be separated. The recognition of the form of the signal as a source for control action includes the concept of the form of the signal as a 'on-line diagnostic tool' for jigs.

The most important fact relating to the operation and control of a jig, in terms of the separation or sorting achieved in the bed is that the separation or sorting is principally influenced by the nature of the fluid flow through the bed as a function of time within the jig cycle. Given that the design of the jigging separator permits the feeding and discharge of materials in an orderly manner, the settings and adjustments on the jigging machine are relevant to control only in so far as they combine to produce a particular variation of the water flow with time within the jig cycle. It may happen that the combinations of settings on the jig controls are such that they do not uniquely determine the water motion in the jig. That is to say, that more than one different combination of settings will produce effectively the same water motion in the jig and hence the same rate and degree of separation.

Because of the relationship between the fluid flow (velocity and acceleration) through a bed of particles and the pressure drop across the bed of particles it is generally true that measurement of fluid pressures at points within or across the particle bed can be used to a greater or lesser extent to infer the state of motion of the water through the particle bed.

It is possible to design instrumentation for immersion in the bed of a jig that permits the determination of the porosity or voidage (volume fraction fluid) in the bed and the variation of voidage as a function of time within the jig cycle. Such instrumentation also permits deduction of the state of fluid motion through the bed as the voidage as a function of time within the jig cycle is, for a given average bed composition, uniquely determined by the water motion.

It is possible to design instrumentation for immersion in the bed of a jig that permits the determination of the velocity of particles as a function of time within the jig cycle.

It is an object of this invention to provide a means of control of a jig (conventional or centrifugal jig or separation in any pulsating separator operating in a manner substantially similar to a jig separator) according to a procedure that relies on the determination of various sensor signals from the jig (their time variation within a cycle of the jig) to control the operating parameters of the jig.

It is a further object to provide a jig (as hereinbefore described) provided with such controls.

It is a further preferred object to provide a control system which does not employ nucleonics.

Other preferred objects will become apparent from the following description.

In one aspect, the present invention resides, for conventional (working under gravity) jigs, centrifugal jigs, and moving screen jigs (working under gravity or centrifugal force, the method of monitoring the jigs by measurement (and optional display) of the time variation within a jig cycle of at least one signal such as bed density, bed voidage, water level, velocity or acceleration in the jigging or air chamber, particle velocity or acceleration in the bed or water or air pressure.

In a second aspect, the present invention resides, for such jigs, in the automatic control of jigs based on the use of the form of the time variation within a jig cycle of such signal(s) wherein one or more of the operating parameters of the jig are manipulated in order to produce the sought-after form of the time variation of the signal within a jig cycle.

In a third aspect, the present invention resides in such jigs monitored and/or controlled by the method hereinbefore described.

With the exception of the aforementioned Australian Patent No. 596858, the prior art in the monitoring and control of jigs has never considered the full variation of any kind of signal within the jig cycle. For example, it is known to have a standpipe communicating with the region beneath the bed plate of a jig at one end and open to the atmosphere at the other end and a means of measuring the water level in that standpipe. It is also known to have a standpipe the same as that mentioned but closed to the atmosphere with a gas space in the top of the pipe and a pressure gauge in the gas space. The peak pressure in the pipe or peak water level in the tube is taken as an indication of the condition of the jig bed and control actions are taken in response to the pressure or level. It is also known to measure the water level in the air chamber of a Batac jig and to apply a control action to the air valves of the jig in order to prevent the maximum or minimum level of the water from reaching certain values.

It is also known to use a 'float' (hollow metal tank of particular weight and volume with stem attached) to attempt to sense a position within the coal bed that has a certain mean density in its undilated state, and to control the discharge of high density material from the jig bed in response to the float position.

It is also known to employ water level sensors above the jigging chamber of a jig so as to sense the maximum and minimum positions of the water in the jigging chamber and to use these discrete signals in conjunction with the sensing of a critical position of the jig bed float to sequence the inlet and exhaust valves.

It is also known to employ a density gauge operating on nucleonic principles, set at a particular horizon or plurality of horizons to sense some coal bed density value in the jig and to regulate the discharge in response to this measurement. The coal bed density sensed may be a time average value over the jig cycle or the density of the bed in the collapsed state or the actual time variation of the density during a cycle.

There are a wide variety of control actions that may be taken in response to various signals from the jig as there are a number of operating conditions of the jig that can be manipulated. Some of these are:

(i) control of inlet or outlet air valve port area in air driven jigs;

(ii) control of opening and closing times of air valves in air driven jigs;

(iii) control of operating air supply pressure in air driven jigs;

(iv) control of the mass flow of gas into the air chamber by a combination of means (i) and (ii)

(v) control of oscillation frequency (jig pulsation frequency) in any kind of jig;

(vi) control the diaphragm motion in diaphragm or centrifugal jigs;

(vii) control of the motion of the bed plate in moving plate jigs;

(viii) control of the centrifugal force in centrifugal jigs;

(ix) control the mean level of water in the air chamber of an air driven jig.

The manner of determination of the control actions to be applied to the above variables may be via specialised controllers functioning in an analog or digital fashion and may include computational analyses of signals and jig responses via Fourier decomposition methods. The manner of determining the control action may also include the real-time computation of the expected jig response to a control action using a mathematical model of the jig. The control action to be taken may additionally include the real-time estimation of the physical parameters of the jigging system (for example (but not limited to), bed mass or bed pressure drop) followed by calculation of jig operating settings, both using a mathematical model of the jig. This latter method of control can be considered to be feed-forward control of the jig combined with real-time identification of jig parameters; it could also be described as self-tuning control of the jigs.

BRIEF DESCRIPTION OF THE DRAWINGS

To enable the invention to be fully understood, a preferred embodiment will now be described with reference to the accompanying drawings, in which.

DETAILED DESCRIPTION OF THE PREFERRED EMBODIMENTS

Figure 1:
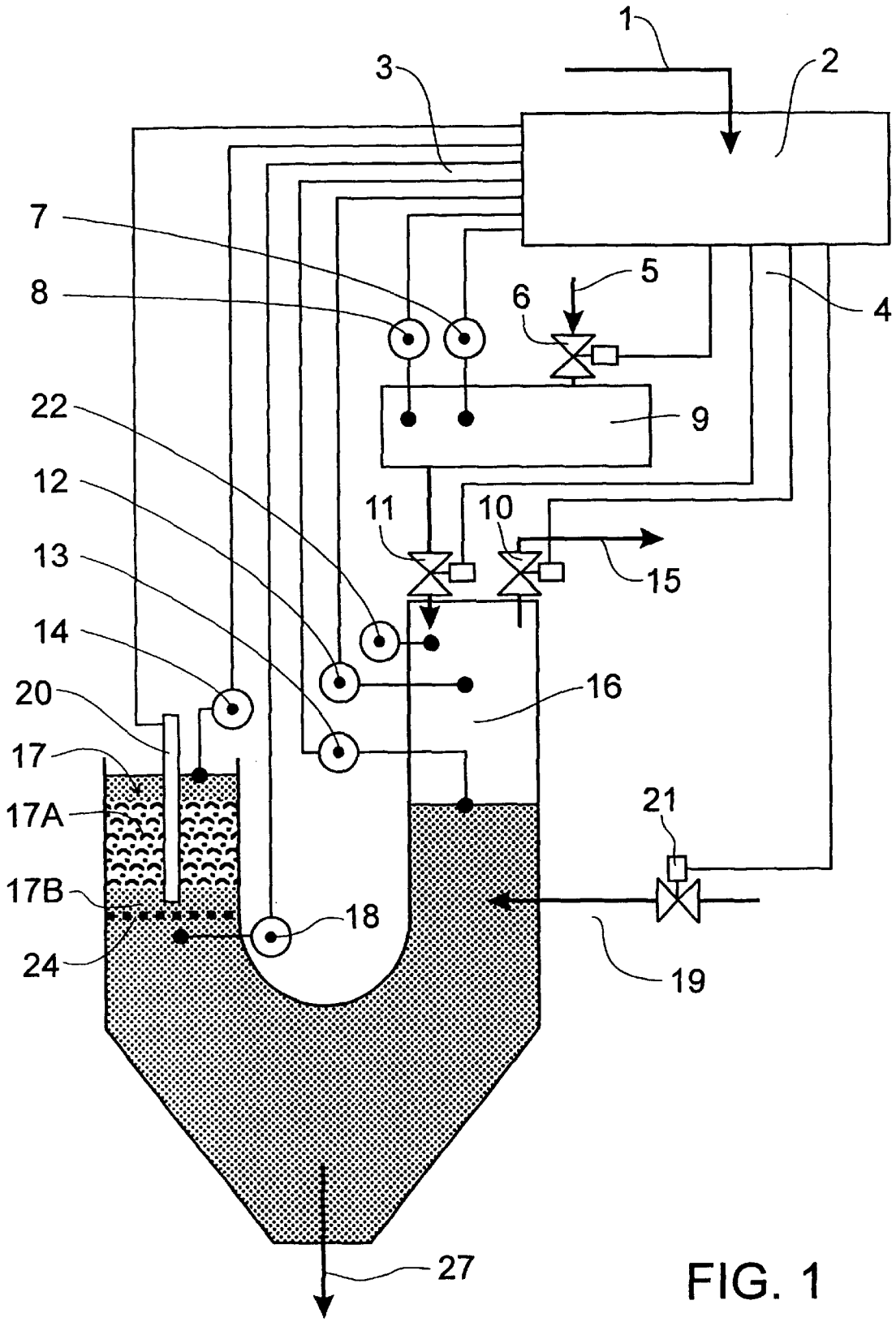
FIG. 1 is an elevation (side view) of a schematised jig with associated measurement sensors and controls.
Figure 2:
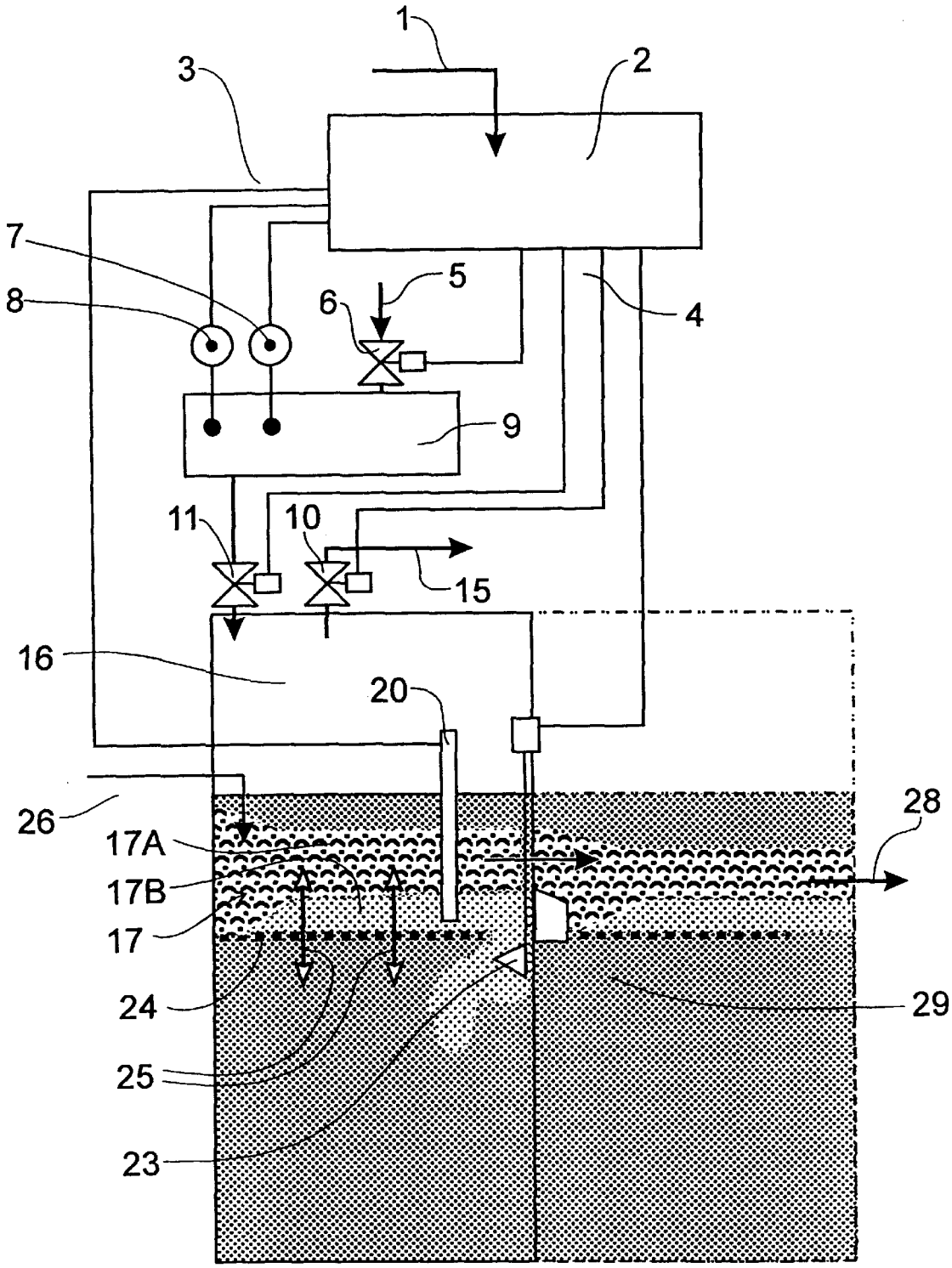
FIG. 2 is a further side view of the jig showing the discharge mechanism and general flow of material through the jig. (We note, however, that the discharge mechanism of the jig is not a required feature of the jig in some types of jigs)

FIG. 1 shows a schematicised drawing of a Baum-type jig with a jig bed 17 composed of a high density layer 17B and a lower density layer 17A supported on a screen plate 24. FIG. 2 shows a side view of th jig looking from the side remote from the air chamber 16. FIG. 2 shows a bed gauging device 20 immersed in the bed 17 and a stylised device 23 for regulation of the rate of flow of higher density material out of the bottom of the bed before the lower density layer passes into the next chamber (shown in dotted lines) and marked as 29. Both the device 20 and the device 23 communicate with the jig controller 2. This controller has marked a set input 1, signal inputs 3 (some not shown in both FIGS. 1 and 2) and outputs 4 (some not shown in both FIGS. 1 and 2). Also communicating with the jig is the flow of unseparated feed material or stream 26 (which may be combined with water), hutch water addition 19 via control valve 21 and supply of compressed air 5 to the air chest 9 via a flow controlling device 6. Low density product is withdrawn at 28 and high density product is withdrawn at 27. The pulsing flow of water through the screen plate 24 is indicated as 25. The tact that these diagrams illustrate a conventional Baum-type jig is not meant to limit the applicability of the means of control to such types of jigs in any way. The admission and exhaust of air from the air chest to the air chamber 16 is via inlet valve 11 and outlet valve 10 (these valves may be combined in a single assembly without loss of generality); stream 15 indicates exhaust air passing to the atmosphere or other device. Air inlet and exhaust valves are not illustrated for the second chamber 29.

In addition to the bed gauging device 20, the jig is equipped with an under-bed pressure sensor 18, gas pressure sensors 22 and 7, and level sensors 13 and 14 in the air chamber and jigging chamber respectively. Such a degree of instrumentation is generally sufficient for the implementation of the control systems.

The general problem of control of a jig involves two principal components, namely, control of the pulsation in the jig and control of the discharge of the products of the separation. (Herein, control of the pulsations is of primary concern).

It was stated above that the stratification in a jig bed is primarily a result of the nature of the flow of the pulsing water through the jig bed. A comprehensive overall control system for a jig can be constructed in the following way, based on the existence of a mathematical model of the motion of the water in the jig. In general, such a mathematical model will include a description of the flow through the supply valve 6, the inlet and exhaust valves 11 and 10 and the hutch water supply valve 21, coupled with dynamic material balances on the air in the air chest 9, the air chamber 16. The remaining elements of the model may be based upon unsteady momentum balances on carefully chosen control volumes containing the water in the jig body, the region around the bedplate 24 and the solids and water in the region above the bed plate. These momentum balances must consider energy losses from flow through the bed plate and the bed of particles. The mathematical model may be formulated as a coupled set of first order differential equations and the solution to the equations is generally computed from a set of initial conditions and a description of the opening and closing times or general modulation of the apertures of the inlet and exhaust valves 11 and 10 and a knowledge of the flow through the air supply valve 6 and the flow through the hutch water supply valve 21. In some cases of jig design, additional elements such as the refuse elevators may have to be considered in the model as the pressure variations in the jig may cause variations in the water level in the refuse elevators (not shown in these diagrams). The mathematical model has various constant parameters imbedded in it which relate to the physical dimensions of the jig and the characteristics of flow through the bed plate and should be capable of providing a solution which accurately matches the measured water motion in the jig, for a given set of operating conditions, with and without solids in the jig. The model also contains parameters relating to the characteristics of the flow through the solids in the jig.

The control system may operate in the following steps.

Firstly, when solids are not being fed to the jig (no flow in stream 26), the controller may cause the jig to pulse with the air control valve(s) operating in a particular sequence or so as to cause a certain mass flow of gas into the air chamber 16. The controller may further cause the average water level in the air chamber (measured by sensor 13) to vary from time to time by changing the settings on the air control valves. From the information recorded from the sensors, the controller may determine by non-linear parameter estimation techniques, estimates of all model parameters in the mathematical model of the jig other than those which relate to the solids to be separated. This exercise of on-line parameter estimation need not in principle be carried out very frequently as the sought-after parameter values will be influenced only by wear of parts or defects or parts in the jig (such as blinded bed plates, leaks, faulty valves and the like). In fact, comparison of consecutive patterns of measured signals or of consecutive sets of estimated parameter values can be used to indicate specific faults in the jig. Included within the scope of the control system is the determination of parameter values at some time interval, not necessarily as a standard component of the control system, and the imbedding of the basic parameters in the mathematical model.

Secondly, when solids are being fed to the jig, the measured values as a function of time within the jig cycle can be used in conjunction with the mathematical model to determine the characteristics of the particle bed in the jig with respect to flow through the bed. The estimation of the bed properties is carried out in a similar manner to that used to estimate jig parameters with no solids in the jig.

Consider that the water motion wave form in the jig chamber (derived from pressure sensor 18 or the level sensor 13) departs from the desired set point wave form (note here that the set point is not considered to be a single numerical value rather the set point is a specified function of time; one way to reduce such a specified function is to describe the function as a finite Fourier series of order N which requires 2N+1 constants and a fundamental frequency) Using the mathematical model with the imbedded constants characterising the solids bed and the other characteristics of the jig, it is possible to calculate the changes in the settings to the inlet and exhaust air valves 11 and 10 and to the supply valve 6 that when applied to the valves will return the water motion to the set point wave form or nearly so. Such a control procedure applied to the jig is not a simple feedback procedure, but it is an adaptive model-based control system and may be applied in consecutive steps to achieve desired control actions.

Various means may be used to determine the valve settings that will return the water motion wave form to its set point wave form. For example, for a variety of particle bed characteristics (total mass and pressure drop constants) the values of the coefficients in the Fourier decomposition of the resulting water wave form may be determined from the model as functions of the air valve settings (expressed either in terms of Fourier decompositions of the wave form applied to each valve or in terms of opening and closing times). Then this functional relationship may be used to determine the valve settings required for the desired wave form by inverting the functional relationship. Alternatively, the model may be used in conjunction with a multi-dimensional minimisation procedure to seek the valve settings that provide the desired water wave form. These calculations are carried Out in the controller while executing such other control functions as may be implemented. In such a case, the controller will be a numerical processor capable of carrying out all calculations in parallel under the overall control of a master processor.

This water wave form control procedure may be carried out in conjunction with other control procedures. For example, the bed gauging device 20, which may be a nucleonic or some other form of device that indicates the extent of bed dilation or variation of bed bulk density as a function of time within the jig cycle, may be used to regulate the rate of discharge of high density material from the jig via device 23. In general, the simultaneous operation of such control loops is important as the stability of jig operation is sensitive to interactions between pulsation (water wave form) and discharge of high density material. For example, in a situation where the amount of high density material in the feed stream 26 increases, there must be a corresponding increase in the mass flow of high density material past the device 23 into the bottom of the jig. If there is not such an increase in mass flow past device 23, the mass of solids in the jig bed will increase and this will generally cause the amplitude of the water wave form to decrease. Such decrease in amplitude will in turn slow the rate of transport of solids along the jig from the feed point to discharge point and lead to further increase in mass of solids in the bed. This situation is clearly unstable but can be ameliorated by maintaining the water wave form in the jig. The combination of water wave form control and control of the rate of discharge of high density material from the jig based on the signal from a bed sensor 20 as described provides a better control of the separation characteristics of the jig than can be achieved by either type of control loop alone.

It is to be noted that, in general, all the sensors indicated are required to implement a control system as described above. In particular, the temperature sensors 8 and 12 are used to provide information necessary to the modelling of the behaviour of the gas phase in the air chest and the air chamber. Industrial jigs that are supplied with air by throttling the air through a valve operate with the gas in the air chest and chambers substantially above ambient temperature and the operating temperature of the gas may vary with the operating conditions of the jig. The pressure sensors 7, 22 and 18 are also required, in general, to determine the parameters of the mathematical model describing the behaviour of the jig. Device 20 may also be equipped with a plurality of pressure sensors arrayed at different heights within the jig bed.

One may also consider the case of a piston or diaphragm jig. The Kelsey centrifugal jig is also a variant of the piston jig. In all these jigs, there is no air chamber and the pulsation is produced directly using a mechanically or electromagnetically driven solid body in direct contact with the liquid in the jig. Oscillation of the solid body produces water pulsion through the bed plate. In the case of such directly driven jigs, the mathematical model of the jig that provides a description of the water or fluid motion in the jig becomes, in some respects, quite trivial in so far as the direct coupling from the driven mechanism to the liquid in the jig body guarantees water motion of a particular wave form unless the body of the jig deforms under the influence of pressure. In such a case, many of the sensors shown in the FIGS. 1 and 2 are unnecessary and the pressure sensor 18 and the bed gauge 20 are very important. Note also, in the Kelsey jig, that there is no discharge device 23 and that high density product is collected in the hutch by passing through the bed plate 24. Also, the bed consists of a relatively thick layer of ragging (generally a solid material of density intermediate between that of the high density product and that of the low density product and coarser than the material to be separated) and a thinner bed of feed material on top of the ragging.

In the example of the Kelsey jig, the control objectives are two-fold. Firstly, the normal operation of the jig must be monitored and secondly, the operation of the jig must be controlled to maintain adequate throughput and separation. A mathematical model that relates the pressure under the bed plate to the characteristics of the bed can be constructed in the same way as for a conventional jig. Since the displacement waveform of the driving body is guaranteed unless the drive breaks down, the pressure beneath the bed plate can be determined as a function of the displacement of the driving body and the bed characteristics. This pressure can then be expected to show a particular variation of pressure beneath the bed as illustrated in FIG. 3.

The separation in the jig depends in part upon there being adequate dilation of the bed, so that the high density particles can pass from the feed side of the bed towards the bed plate at a reasonable rate. This dilation in turn depends upon the pulse of water through the bed plate being adequate to lift the bed. The point of lifting of the bed is characterised by the point in the pressure wave form where the pressure is above the average value and becomes approximately constant. If the pressure wave form does not display the correct shape and magnitude, it can then be deduced that the conditions in the bed have changed. Indeed, in the same way as can be done in a conventional jig, the bed characteristics (flow parameters) can be estimated using the mathematical model of the jig. A typical disturbance to the conditions in the bed is a change in the total mass flow of solids to the separator or a change in the content of high density material in the feed, or both. All these conditions result in a change in the required mass flow of high density material through the bed plate. The control action that is required in response to particular changes in the pressure wave form varies according to the nature of the change and the nature of the separation being carried out. One may consider making a change in hutch water flow, or a change in throughput of feed solids, or a change in frequency of pulsation or ultimately, a change in amplitude of pulsion with the final object of restoring the indication in the pressure wave form of dilation to a desired state.

Figure 3:
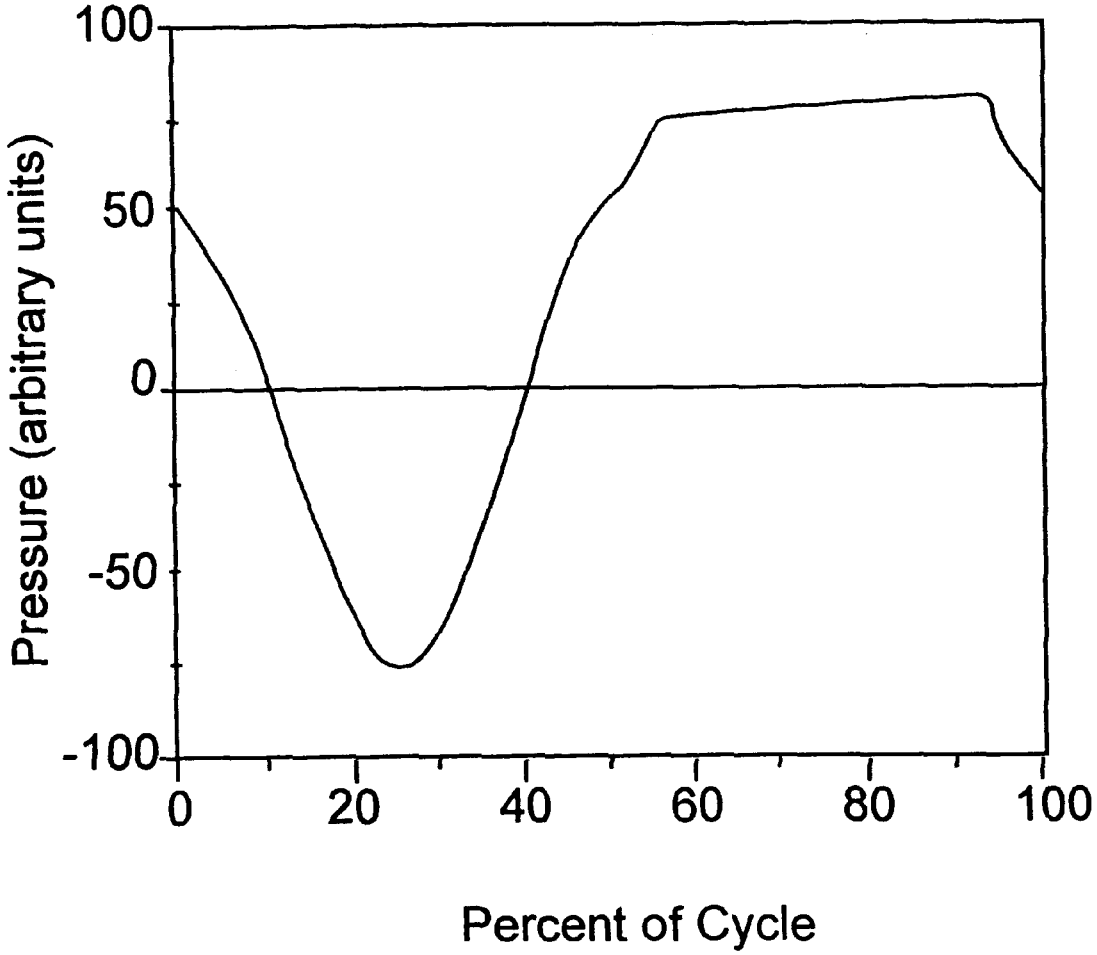
FIG. 3 shows the cyclical (one cycle) of variation of the pressure under the bed of the jig.

With reference to the pressure wave form in FIG. 3, the time period of the 'clipped' portion of the wave form (i.e. from approximately 55% to 95% of the cycle period) must be at least equal to, and preferably greater than, the time for the voidage wave to travel up through the bed ensuring that the bed is fluidised on each cycle. If the time period is less than the voidage wave travel time, the bed is not fully dilated and effectively acts as a screen or sieve, with respect to the particles to be separated. Any partial screening of the bed, when only partial dilation occurs, will restrict the movement of larger diameter higher density particles towards the bottom of the bed.

The present invention is the first recognition that the wave form of the water pressure in the jig can provide a set point for the control of the jig.

Various changes and modifications may be made to the embodiments described and illustrated without departing from the scope of the present invention defined in the appended claims.

We claim:

1. A method of monitoring jig separators for minerals in a bed on the jig, comprising the step of:

measurement of a time variation with a jig cycle of at least one signal responsive to an operating parameter selected from the group consisting of bed voidage, water level, velocity or acceleration in a jigging or air chamber, particle velocity or acceleration in the bed and water or air pressure.

2. A method of automatic control of jig separators for minerals in a bed on the jig including the steps of:

using a form of the time variation within a jig cycle of at least one signal, responsive to an operating parameter selected from the group consisting of bed voidage, water level, velocity or acceleration in a jigging or air chamber, particle velocity or acceleration in the bed and water or air pressure, wherein:

one or more of the operating parameters of the jig are manipulated in order to produce a sought-after form of time variation of the signal within a jig cycle.

3. A method as claimed in claim 2, wherein:

the operating parameters are selected from one or more of the members of a group consisting of:

(i) control of inlet or outlet air valve port area in air driven jigs;

(ii) control of opening and closing times of air valves in air driven jigs;

(iii) control of operating air supply pressure in air driven jigs;

(iv) control of the mass flow of gas into an air chamber by a combination of (i) and (ii);

(v) control of oscillation frequency of any kind of jig;

(vi) control of a diaphragm motion in diaphragm or centrifugal jigs;

(vii) control of motion of a bed plate in moving plate jigs;

(viii) control of centrifugal force in centrifugal jigs; and (ix) control of a mean level of water in an air chamber of an air driven jig.

4. A method as claimed in claim 3 wherein:

a manner of determination of control actions to be applied to the operating parameters is by controllers functioning in an analog or digital fashion and includes computational analyses of signals and jig responses via Fourier decomposition methods.

5. A method as claimed in claim 4 wherein:

the manner of determining the control action includes a real-time computation of expected jig response to a control action using a mathematical model of the jig; and the control action to be taken additionally includes the real-time estimation of physical parameters of the jigging system, including bed mass or bed pressure drop, followed by calculation of jig operating settings, both using a mathematical model of the jig.

6. A method as claimed in claim 5 wherein:

the method of control is a feed-forward control of the jig combined with real-time identification of jig parameters, or a self-tuning control of the jig.

7. An apparatus for monitoring or control of jig separators for minerals in a bed on the jig, comprising:

means for measuring a time variation within a jig cycle of at least one signal responsive to an operating parameter selected from the group consisting of bed voidage, water level, velocity or acceleration in a jigging or air chamber, particle velocity or acceleration in the bed and water or air pressure.

* * * * *